US005122173A

United States Patent [19]

Agrawal et al.

[11] Patent Number: 5,122,173

[45] Date of Patent: * Jun. 16, 1992

[54] CRYOGENIC PRODUCTION OF KRYPTON AND XENON FROM AIR

[75] Inventors: Rakesh Agrawal, Allentown; Brian E. Farrell, Fogelsville, both of Pa.

[73] Assignee: Air Products and Chemicals, Inc., Allentown, Pa.

[ * ] Notice: The portion of the term of this patent subsequent to Nov. 12, 2008 has been disclaimed.

[21] Appl. No.: 650,836

[22] Filed: Feb. 5, 1991

[51] Int. Cl.[5] ..... F25J 3/04

[52] U.S. Cl. ..... 62/22; 55/66; 423/262

[58] Field of Search ..... 62/22; 55/66; 423/262

[56] References Cited

U.S. PATENT DOCUMENTS

| | | | |
|---|---|---|---|
| 3,596,471 | 8/1971 | Streich | 62/22 |
| 3,751,934 | 8/1973 | Frischbier | 62/22 |
| 4,384,876 | 5/1983 | Mori et al. | 62/22 |
| 4,401,488 | 8/1983 | LaClair | 62/22 |
| 4,421,536 | 12/1983 | Mori et al. | 62/22 |
| 4,568,528 | 2/1986 | Cheung | 423/262 |
| 4,647,299 | 3/1987 | Cheung | 62/22 |

OTHER PUBLICATIONS

H. Dauer, "New Developments Resulting on Improved Production of Argon, Krypton and Xenom".

*Primary Examiner*—Ronald C. Capossela

*Attorney, Agent, or Firm*—Willard Jones, II; William F. Marsh; James C. Simmons

[57] ABSTRACT

The present invention relates to a process for the production of krypton and xenon from a cryogenic air separation unit. The present invention simultaneously concentrates krypton and xenon while rejecting more than 90% of the methane present in the feed stream. The feed to the process is a liquid oxygen stream which is withdrawn from the main distillation column system of the air separation unit. The improvement of the present invention is the discovery that an optimum liquid to vapor flow is required in the oxygen enriching section of the krypton/xenon column. The optimum range is between 0.05 to 0.2, more preferably about 0.1.

12 Claims, 7 Drawing Sheets

CRYOGENIC PRODUCTION OF KRYPTON AND XENON FROM AIR

TECHNICAL FIELD

The present invention relates to the cryogenic separation of air into its constituent components, in particular, the recovery of krypton and xenon.

BACKGROUND OF THE INVENTION

Krypton and xenon are present in air as trace components, 1.14 vppm and 0.086 vppm, respectively, and can be produced in pure form from the cryogenic distillation of air. Both of these elements are less volatile (i.e., have a higher boiling temperature) than oxygen and therefore concentrate in the liquid oxygen sump in a conventional double column air separation unit. Unfortunately, other impurities which are less volatile than oxygen, such as methane, also concentrate in the liquid oxygen sump along with krypton and xenon.

Unfortunately, process streams containing oxygen, methane, krypton and xenon present a safety problem due to the combined presence of methane and oxygen.

Methane and oxygen form flammable mixtures with a lower flammability limit of 5% methane in oxygen. In order to operate safely, the methane concentration in an oxygen stream must not be allowed to reach the lower flammability limit and, in practice, a maximum allowable methane concentration is set that is a fraction of the lower flammability limit. This maximum effectively limits the concentration of the krypton and xenon that are attainable as any further concentration of these products would also result in a methane concentration exceeding the maximum allowed. Therefore, it is desirable to remove methane from the process.

Methane is currently removed from the krypton and xenon concentrate stream using a burner that operates at 800–1000° F. The burning of methane produces two undesirable by-products, water and carbon dioxide, in the process stream. These impurities are typically removed by molecular adsorption. Therefore, the current method of removing methane requires a methane burner, an adsorption system, and several heat exchangers to warm the stream from a cryogenic temperature to the burner temperature and then back to a cryogenic temperature after the adsorption step. Methane removal in this manner also results in some loss of krypton and xenon.

Numerous processes are taught in the background art, among these are the following:

A method of operation of a krypton/xenon column is disclosed in a publication by H. Dauer entitled "New Developments Resulting in Improved Production of Argon, Krypton and Xenon". The relevant portion of the disclosed process is shown in FIG. 1. In the method, liquid oxygen is withdrawn from the bottom of low pressure column of an air separation unit, passed through a hydrocarbon adsorber, and fed to the top of the krypton/xenon column. The hydrocarbon adsorber does not remove methane from the liquid oxygen stream. Liquid in the sump of the krypton/xenon column is reboiled using air from the high pressure column to provide vapor in the krypton/xenon column. Vapor that exits the top of the column contains primarily oxygen with krypton, xenon, and methane. This vapor is added to the gaseous oxygen product stream. Krypton loss in this stream is 11% of the krypton that entered with the liquid oxygen feed. A liquid product stream is recovered from the bottom of the krypton/xenon column that contains a combined krypton and xenon concentration of approximately 0.3% and a methane concentration of 0.5% (the maximum allowable limit). The liquid to vapor ratio (reflux ratio) in the krypton/xenon column is greater than 1.0 at all locations in the column when operated in this manner.

Another process that produces a stream concentrated in krypton and xenon by cryogenic methods is disclosed in U.S. Pat. No. 4,401,448. The process uses two columns to concentrate krypton and xenon in addition to the standard double column air separation unit. In this process, a gaseous oxygen stream is withdrawn from below the first tray of the low pressure column and fed below the first tray of the rare gas stripping column. Reflux for this column is provided by a liquid oxygen stream withdrawn from the low pressure column at a point above where the gaseous oxygen stream was taken. Boilup in the rare gas stripping column is provided by indirect heat exchange with a gaseous nitrogen stream from the high pressure column. Vapor exiting from the top of the rare gas stripping column operates at a reflux ratio of 0.1 to 0.3 (preferred value 0.2). Liquid that is concentrated in krypton, xenon and hydrocarbons is withdrawn from the bottom of rare gas stripping column is fed to the top of the oxygen exchange column. A gaseous nitrogen stream, taken from the high pressure column, is introduced below the first stage of the oxygen exchange column such that the reflux ratio is 0.15 to 0.35 (preferred value 0.24). Boilup in the oxygen exchange column is provided by indirect heat exchange with a gaseous nitrogen stream from the high pressure column. Vapor exiting the top of the oxygen exchange column is recycled to the low pressure column. A liquid product that is concentrated in krypton and xenon is withdrawn from the bottom of the oxygen exchange column.

U.S. Pat. No. 4,401,448 reports results from a computer simulation of the process described above. The liquid product stream withdrawn from the oxygen exchange column contained 1.0% oxygen, 11000 ppm krypton, 900 ppm xenon, and 3200 ppm hydrocarbons with balance being nitrogen. This scheme alleviated two problems associated with prior processes. First, introduction of nitrogen at the bottom of the oxygen exchange column effectively displaces oxygen such that the product stream withdrawn from this column does not contain enough oxygen to form a flammable mixture with hydrocarbons. Second, the process is cryogenic. Krypton recovery was calculated as 72% from data presented in the patent and such a low recovery is undesirable.

Another method of operating a raw krypton column to produce a stream concentrated in krypton and xenon is disclosed in U.S. Pat. No. 4,568,528. A liquid oxygen stream is withdrawn from the low pressure column and introduced to the reboiling zone of the raw krypton column without being passed through a hydrocarbon adsorber. This feed liquid is partially vaporized to produce vapor and a liquid product concentrated in krypton and xenon. The column is refluxed by a liquid having krypton and xenon in lower concentration than the vapor formed in the reboiling zone. This reflux liquid is a stream withdrawn a few trays above the sump of the LP column and contains hydrocarbons that will accumulate in the sump of the raw krypton and limit the krypton/xenon concentration in the product stream.

Vapor withdrawn from the top of the column is added to the gaseous oxygen product.

One major disadvantage of this process is the loss of krypton and xenon in a hydrocarbon adsorber which has to be subsequently used to remove hydrocarbons. Since concentration of krypton and xenon in the stream to the hydrocarbon adsorber is higher than that in feed stream, a larger fraction of krypton and xenon is lost as compared to the typical case where a hydrocarbon adsorption unit is used on the feed stream. However, if a hydrocarbon adsorber were to be used on this feed stream then a hydrocarbon adsorption unit will have to be used on the reflux stream which is also contaminated with hydrocarbons. This adds cost and complexity to the process taught in the U.S. Pat. No. 4,568,528.

SUMMARY OF THE INVENTION

The present invention relates to an improvement to a process for the production of krypton and xenon from a liquid feed stream comprising oxygen, methane, krypton and xenon in a krypton/xenon cryogenic distillation column system having at least one distillation column. In the process the liquid feed stream is introduced to the krypton/xenon cryogenic distillation column system for fractionation into a bottoms liquid enriched in krypton and xenon and an overhead lean in krypton and xenon. The krypton/xenon cryogenic distillation column system has at least one region wherein oxygen is enriched. The improvement for simultaneously maximizing the concentration of krypton and xenon and the rejection of methane comprises operating said region wherein oxygen is enriched so that ratio of liquid to vapor flow is in the range between 0.05 and 0.2.

The process present invention can further comprise removing any $C_2$+hydrocarbons and nitrous oxide from the liquid feed stream in a hydrocarbon adsorber prior to introducing the feed stream to the krypton/xenon distillation column system.

DESCRIPTION OF THE INVENTION

The present invention relates to a process for the cryogenic production of krypton and xenon from a cryogenic air separation unit. The primary objective of the present invention is to remove methane while concentrating krypton and xenon. The process of the present invention has four embodiments that achieve this objective of methane removal while concentrating krypton and xenon. The common feature of all these embodiments is that each recognize the need and suggest methods to optimize the liquid to vapor flow ratio (L/V) in the oxygen enriching section of the krypton/xenon distillation column. This value of L/V is optimized around 0.05 to 0.2 such that methane is preferentially (as compared to krypton and xenon) rejected in the oxygen rich vapor stream leaving the distillation system.

Embodiment #1

Figure 2:
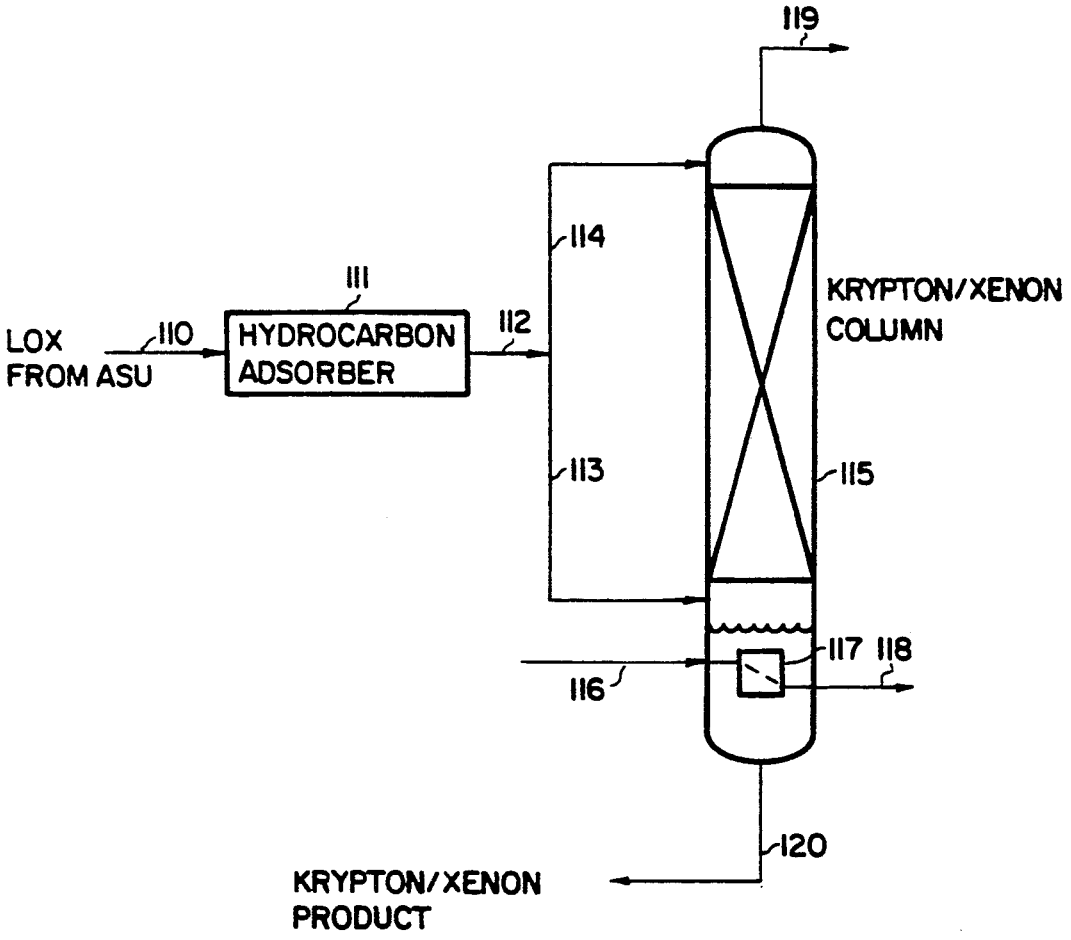
FIGS. 2 through 7 are schematic diagrams of differing embodiments of the process of the present invention.

The first embodiment comprises the combination of a hydrocarbon adsorber and the krypton/xenon distillation column as shown in FIG. 2. With reference to this figure, liquid oxygen stream 110 is withdrawn from the sump of a suitable distillation column of the main air separation unit and is passed through hydrocarbon adsorber 111. This hydrocarbon adsorber 111 removes any $C_2$+hydrocarbons and nitrous oxide contained in liquid oxygen stream 110, but does not remove methane. The liquid oxygen stream 112 exiting the adsorber is split into two streams; feed stream 113 and liquid reflux stream 114. Feed stream 113 is fed to the bottom of krypton/xenon column 115 for rectification; the feed is preferentially introduced to the column at a point above the reboiling zone and below the first equilibrium stage. Boilup in krypton/xenon column 115 is provided in reboiler 117 by indirect heat exchange between liquid in the sump of the column and any suitable process stream 116. Example of suitable stream 116's include, but are not limited to, gaseous nitrogen withdrawn from the high pressure column or liquid withdrawn from the high pressure column of the main air separation unit. This cooled process stream 116, now stream 118, can be recycled to an appropriate place in the main air separation unit, or used as a condensing or reboiling fluid in another indirect heat exchanger, or any combination of the above. Liquid reflux stream 114 is fed to the top of krypton/xenon column 115 to provide liquid reflux. In krypton/xenon column 115, the down-flowing liquid removes krypton and xenon preferentially to the other components from the ascending vapor stream such that krypton and xenon losses in waste stream 119 are small. Waste stream 119 is recovered as gaseous oxygen product. Krypton/xenon column 115 is operated such that vapor stream 119 contains greater than 90% of the methane that entered the column in streams 113 and 114. To accomplish this operation, the split in the liquid oxygen fed to the column via streams 113 and 114 must be such that stream 114 is adequate to provide sufficient reflux to krypton/xenon column 115 so as to maintain an L/V flow (reflux) ratio in column 115 between 0.05 and 0.2. Liquid product stream 120 is withdrawn from the reboiler sump of krypton/xenon column 115. Stream 120 consists of krypton, xenon, and some methane concentrated in oxygen.

Operating krypton/xenon column 115 at the proper reflux ratio allows removal of greater than 90% of the methane from the process with little loss of krypton and xenon. A computer simulation of the process of FIG. 2 is presented in Table I. For this case, the column was operated at a reflux ratio of 0.17 and contained 23 theoretical stages for separation.

TABLE I

| Stream No. | 112 | 113 | 114 | 119 | 120 |
|---|---|---|---|---|---|
| Flow: mol/hr | 100.0 | 83.0 | 17.0 | 99.8 | 0.2 |
| Pressure: psia | 23.1 | 23.1 | 22.8 | 22.8 | 24.3 |
| Temperature: °F. | −289.2 | −289.2 | −289.4 | −289.4 | −287.9 |
| Composition | | | | | |
| Oxygen: vol % | 99.93 | 99.93 | 99.93 | 99.94 | 98.47 |
| Argon: vppm | 400.0 | 400.0 | 400.0 | 400.3 | 243.0 |
| Krypton: vppm | 27.1 | 27.1 | 27.1 | 1.9 | 12620 |
| Xenon: vppm | 2.05 | 2.05 | 2.05 | — | 1022 |
| Methane: vppm | 238.1 | 238.1 | 238.1 | 235.6 | 1463 |

The effect of reflux ratio on the operation of the column is shown in Table II. The flow of stream 112 was held constant and 23 theoretical stages were employed for the four cases shown.

TABLE II

| | Case 1 | Case 2 | Case 3 | Linde |
|---|---|---|---|---|
| Reflux Ratio | 0.09 | 0.17 | 0.27 | 1.04 |
| Methane Rejection: %[1] | 99.2 | 98.8 | 95.9 | 29.0 |
| Krypton Recovery: %[2] | 90.1 | 93.1 | 93.2 | 93.4 |
| Stream 120 Flow: mol/hr | 0.20 | 0.20 | 0.20 | 3.50 |
| Stream 120 Composition | | | | |
| Krypton: vppm | 12208 | 12620 | 12621 | 723 |
| Xenon: vppm | 1022 | 1022 | 1022 | 58 |
| Methane: vppm | 1007 | 1463 | 4908 | 4833 |

[1]Ratio of methane in stream 119 to methane in stream 112
[2]Ratio of krypton in stream 120 to krypton in stream 112

As can be seen, decreasing the reflux ratio from 0.17 to 0.09 resulted in a decrease in krypton recovery from 93.1% to 90.1%. Further decreases in the reflux ratio result in even greater krypton losses for the fixed number of stages in the column. Increasing the reflux ratio from 0.17 to 0.27 results in decreased rejection of methane such that product stream 20 contains 3.4 times more methane. These results demonstrate the value of operating at an optimum reflux ratio as operating below the optimum results in an unacceptably high krypton loss and operating above the optimum results in unacceptably low methane rejection.

Figure 1:
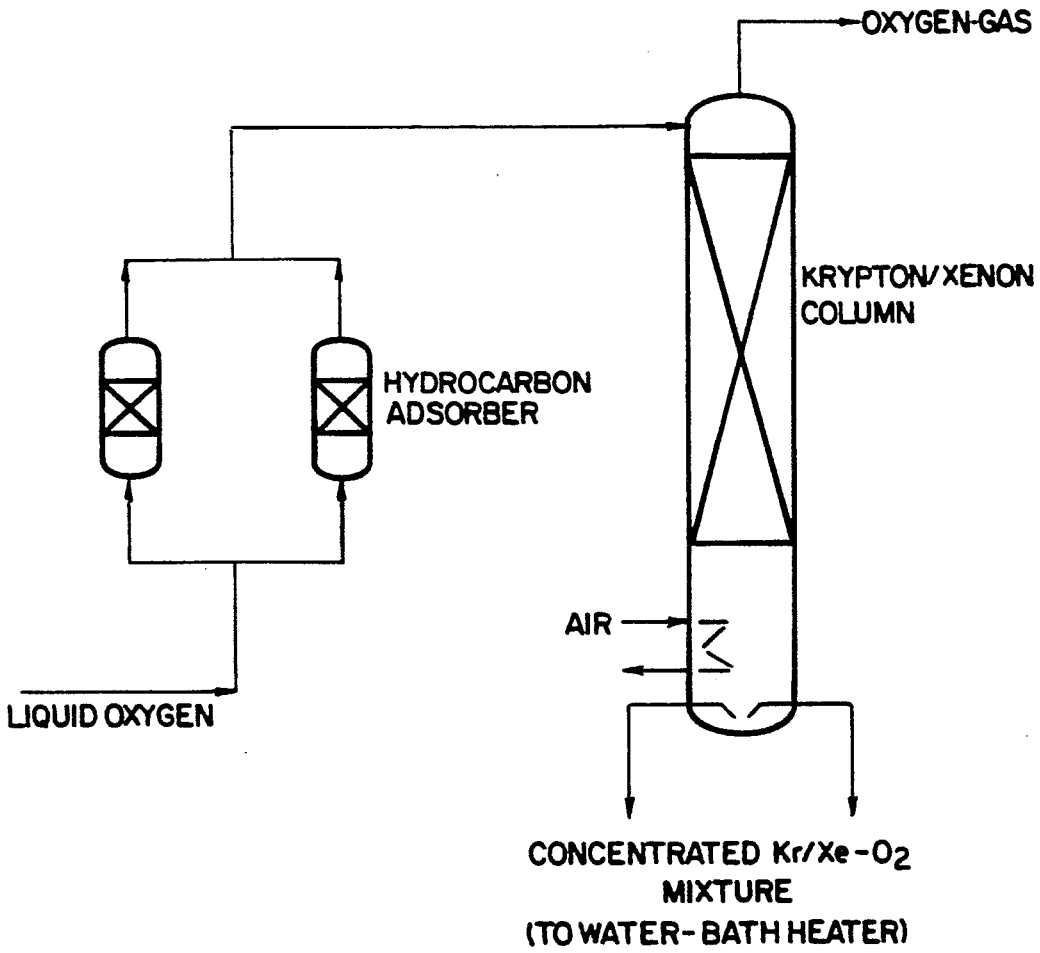
FIG. 1 PRIOR ART
FIG. 1 is a schematic diagram of the process taught in the background art.

The embodiment shown in FIG. 2 is compared to the process shown in FIG. 1 (the Linde process), as described in the article by H. Dauer in the Background of the Invention section, in Table II; data for the Linde process are presented in Table II under the heading "Linde". As stated previously, the Linde process must operate at a reflux ratio greater than 1.0. The most significant consequence of this constraint is that the krypton/xenon column rejects only 29% of the methane that enters with the feed. The methane that is not removed in the vapor leaving the top of the column concentrates in the liquid product stream. The flowrate of the liquid product stream must be increased by a factor of 17.5 in order to maintain the methane concentration below the maximum allowable value of 5000 ppm. This action has the detrimental effect of lowering the krypton and xenon concentrations in the product stream by a factor of approximately 17.5 (Case 2 vs. Linde). The increased product flowrate in the Linde process also requires larger equipment for downstream processing.

The primary innovation of the present embodiment as compared to the Linde process is that the feed stream is split and fed to the krypton/xenon column at two locations as shown in FIG. 2 versus one feed location in the Linde process. Splitting the feed allows operation of the krypton/xenon column at a reflux ratio below 1.0. The results of Table II indicate that the optimum reflux ratio for the krypton/xenon column is approximately 0.17, a value not attainable using the Linde AG process. Of course, if desired, feed to the krypton/xenon column can be split into more than two streams such that L/V could be optimized along the length of the column to enhance the methane rejection and reduce the krypton/xenon loss.

EMBODIMENT 2

A further improvement to the process disclosed in Embodiment 1 (see FIG. 2) is to reduce the relatively high krypton loss (6.9%). This loss can be reduced by adding additional equilibrium stages to the krypton/xenon column (at the expense of additional capital) or by refluxing the krypton/xenon column with a liquid that has lower concentrations of krypton and xenon than the reflux liquid used in the process of Embodiment 1 (FIG. 2). This second embodiment discloses a process for the use of such a reflux liquid.

U.S. Pat. No. 4,568,528 demonstrates a process that refluxes the krypton/xenon column with a liquid having lower concentrations of krypton and xenon than the feed. In this process, all of the feed is fed at the bottom of the column. The reflux liquid is withdrawn from 1 to 5 equilibrium stages above the sump of the low pressure column of the main air separation unit and contains approximately 3 vppm of krypton and xenon. In an example presented in said patent, the column operated at a reflux ratio of 0.16 resulting in a krypton recovery of 97.3%.

The process of U.S. Patent 4,568,528 yields an increase in krypton recovery (as compared to the Embodiment I process) but does not solve the problem of hydrocarbon and nitrous oxide removal. Both the feed stream and liquid reflux stream contain methane and additional hydrocarbons and nitrous oxide since neither stream passes through a hydrocarbon adsorber prior to being fed to the krypton/xenon column.

Figure 3:
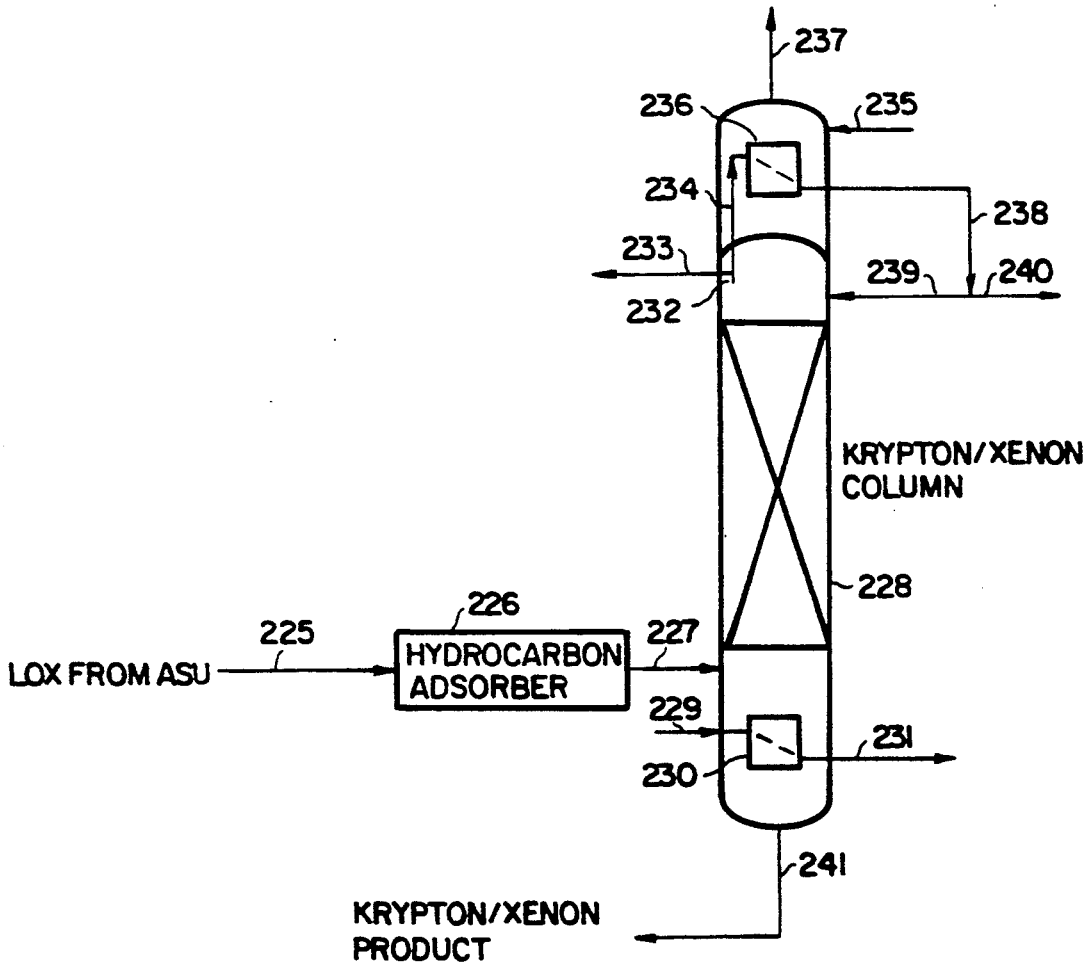

Embodiment 2 addresses the issue of hydrocarbon removal and results in high recoveries of krypton and xenon; this process is illustrate in FIG. 3. With reference to FIG. 3, liquid oxygen stream 225 is withdrawn from the sump of a suitable distillation column of the main air separation unit and is passed through hydrocarbon adsorber 226. This hydrocarbon adsorber 226 removes any $C_2$+hydrocarbons and nitrous oxide contained in liquid oxygen stream 225, but does not remove methane. Liquid oxygen stream 227 exiting adsorber 226 is fed to the bottom of krypton/xenon column 228, at a point above the reboiling zone and below the first equilibrium stage. Boilup in krypton/xenon column 228 is provided by indirect heat exchange between liquid in the sump of the column and any suitable process stream 229 in reboiler 230 as described previously for Embodiment 1. In krypton/xenon column 228, ascending vapor 232, which is essentially krypton and xenon-free, is collected above the top equilibrium stage and split into two streams 233 and 234. Stream 233 is recovered as gaseous oxygen product. Stream 234 is condensed by indirect heat exchange with any suitable process stream 235 in condenser 236, as shown. Vaporized process stream 237 is returned to an appropriate place in the main air separation unit. Liquid condensate 238 can be split into two fractions, streams 239 and 240. Stream 239 is returned to the krypton/xenon column above the top equilibrium stage as liquid reflux. Stream 240 is recovered as a liquid oxygen product. Greater than 90% of the methane that entered the process in stream 227 is removed in streams 233 and 240. It will be evident to those who are skilled in the art that the system described in FIG. 3 allows for the recovery of oxygen from the krypton/xenon column as either all gaseous oxygen (stream 233) or all liquid oxygen (stream 240) or any combination of gaseous oxygen and liquid oxygen. Krypton and xenon are recovered in product stream 241.

It should be evident that condenser 236 can be a discrete piece of equipment at the top of krypton/xenon column 228 (as shown) or be integrated with another condenser in a different location, such as the argon column condenser. If integrated with the argon column condenser then the vapor from the top of krypton/xenon column 228 will be condensing against boiling the same fluid which is boiled by crude argon from the argon column condenser. Typically this fluid is crude liquid oxygen from the bottom of the high pressure column. This integration of the condenser 236 with the argon column condenser will virtually eliminate the capital costs associated with the introduction of the condenser 236 in FIG. 3.

The results of a computer simulation of the process shown in FIG. 3 are shown in Table III. As was the case for the process of FIG. 2, 23 theoretical stages were employed in the krypton/xenon column.

TABLE III

| Stream No. | 227 | 232 | 233 | 239 | 241 |
|---|---|---|---|---|---|
| Flow: mol/hr | 100.0 | 112.7 | 99.8 | 12.9 | 0.2 |
| Pressure: psia | 23.1 | 22.8 | 22.8 | 22.8 | 24.3 |
| Temperature: °F. | −289.2 | −289.4 | −289.4 | −289.4 | −287.9 |
| Composition | | | | | |
| Oxygen: vol % | 99.93 | 99.93 | 99.93 | 99.93 | 98.4 |
| Argon: vppm | 400 | 613 | 613 | 613 | 249 |
| Krypton: vppm | 27.1 | 0.1 | 0.1 | $<1.1\ E^{-7}$ | 13547 |
| Xenon: vppm | 2.05 | 0.1 | 0.1 | $<1.1\ E^{-7}$ | 1025 |
| Methane, vppm | 238.1 | 236.4 | 236.4 | 236.4 | 1103 |

The optimal reflux ratio for the process of the present embodiment (FIG. 3) is approximately 0.11 and the results in Table III are for a simulation using this value. Krypton recovery is 99.9% and methane rejection is 99.1%.

The process of FIG. 3 is an improvement over the process of FIG. 2, i.e., better krypton recovery. Krypton recovery increased from 93.1% in the process of FIG. 2 to 99.9% in the process of FIG. 3. The increased krypton recovery is higher than the value of 97.3% reported in U.S. Pat. No. 4,568,528. However, the increased krypton recovery in the process of FIG. 3 comes at the expense of slightly increased capital (the condenser at the top of the krypton/xenon column). As stated earlier, this cost could substantially decrease if this condenser is combined with other major condensers already being used in the plant. The increased krypton recovery of U.S. Pat. No. 4,568,528 comes at the expense of decreased hydrocarbon removal and this is undesirable.

One could argue that the process of U.S. Pat. No. 4,568,528 would be desirable if both the feed liquid and liquid reflux were passed through separate hydrocarbon adsorbers prior to entering the krypton/xenon column. Such action would help to solve the problem of hydrocarbon and nitrous oxide removal but would do so at the expense of additional capital and process complexity.

Embodiment #3

Figure 4:
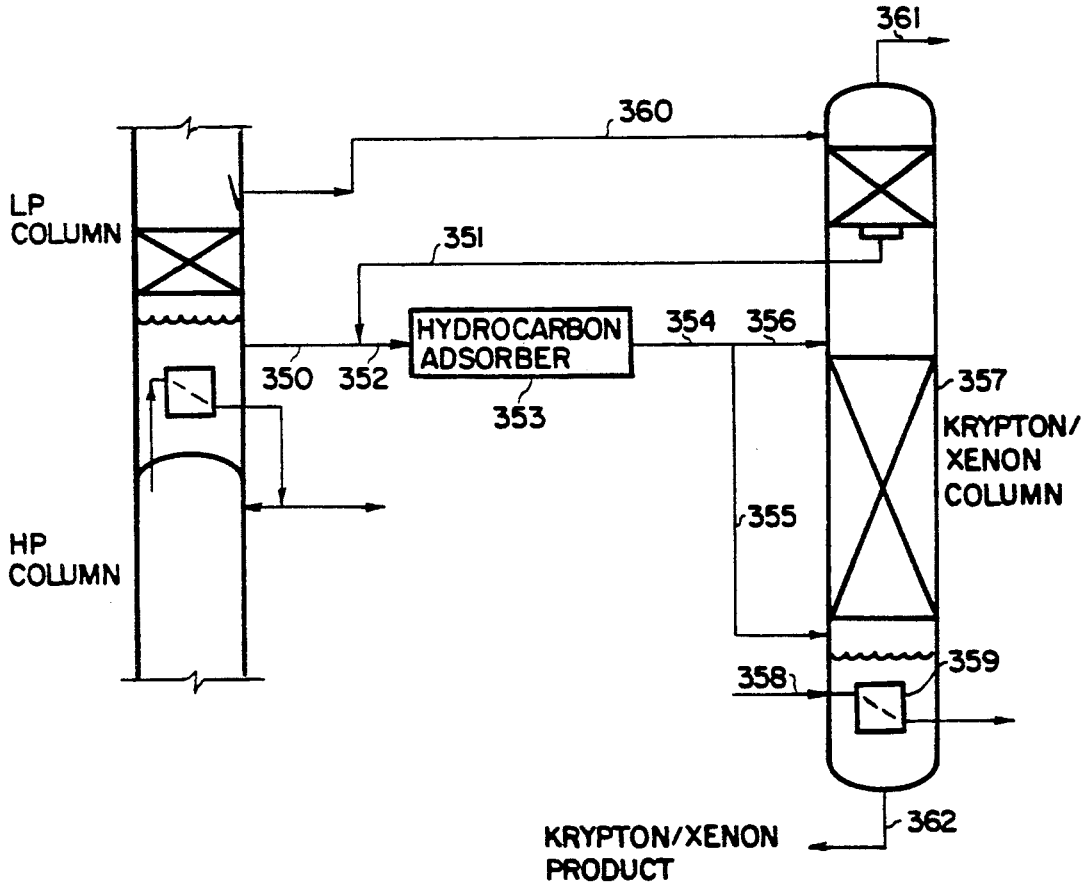

The third proposal presents a novel process that results in high krypton and xenon recovery and hydrocarbon and nitrous oxide removal without significantly increasing capital or adding process complexity, as shown in FIG. 4. With reference to FIG. 4, liquid oxygen stream 350 is withdrawn from the sump of an appropriate column of the main air separation unit, combined with liquid return stream 351 to form hydrocarbon adsorber feed stream 352, and passed through hydrocarbon adsorber 353. Methane is not removed in this adsorber. Hydrocarbon adsorber product stream 354 is divided into two (2) fractions, bottom feed 355 and intermediate feed 356. Bottom feed 355 is fed to the bottom of krypton/xenon column 357 at a point above the reboiling zone and below the first equilibrium stage. Boilup in krypton/xenon column 357 is provided by indirect heat exchange between liquid in the sump of the column and any suitable process stream 358 in reboiler 359. Liquid reflux stream 360 is withdrawn from a point above the sump from the same column of the main air separation unit as liquid oxygen stream 350. Liquid reflux stream 360 contains lower concentrations of krypton and xenon than liquid oxygen stream 350 and also contains some hydrocarbons. As a result, this descending liquid preferentially removes krypton, and xenon from the ascending vapor in the top section of the krypton/xenon column 357 such that gaseous oxygen stream 361 contains greater than 90% of the methane that entered in streams 350 and 360 and is essentially krypton and xenon-free. Liquid product stream 362 is collected at the bottom of the column and contains virtually all of the krypton and xenon that entered in streams 350 and 360, along with some residual methane, in oxygen.

The novel concept of FIG. 4 is the withdrawal of liquid return stream 351 from krypton/xenon column 357. Reflux liquid 360 is fed directly from an appropriate column in the main air separation unit to krypton/xenon column 357 and contains some hydrocarbons and/or nitrous oxide. These hydrocarbons and or nitrous oxide will accumulate in the sump of the krypton/xenon column and, if not removed, will limit the concentrations of krypton and xenon in liquid product stream 362. This is exactly what occurs in U.S. Pat. No. 4,568,528 as discussed previously. All of the liquid in the upper portion of the column is removed in liquid return stream 351, mixed with liquid oxygen stream 350, passed through hydrocarbon adsorber 353, and then returned to the krypton/xenon column in feed streams 355 and 356. In this way, hydrocarbons that enter the krypton/xenon column in liquid reflux 360 are removed and do not accumulate in the column sump. Intermediate feed 356 is returned to krypton/xenon column 357 between the same two equilibrium stages between which stream 351 was withdrawn.

A computer simulation was performed on the process of FIG. 4 and is summarized in Table IV. For this case, 23 equilibrium stages were employed in krypton/xenon column 357, liquid return stream was withdrawn 6 stages down from the top of the column and intermediate feed 356 was fed at this location. The flowrates of streams 351 and 356 were equal such that krypton/xenon column 357 operated at a constant reflux ratio of 0.11. However, in general, the two sections of the krypton/xenon column can operate at different L/Vs. Krypton recovery (ratio of krypton in stream 362 to total krypton in streams 350 and 360) was 99.4% and methane removal (ratio of methane in stream 361 to total methane in streams 350 and 360) was 98.6% for this example.

TABLE IV

| Stream No. | 350 | 351 | 355 | 356 | 360 | 361 | 362 |
|---|---|---|---|---|---|---|---|
| Flow: mol/hr | 89.0 | 11.0 | 89.0 | 11.0 | 11.0 | 99.8 | 0.2 |
| Pressure: psia | 23.1 | 23.1 | 23.1 | 23.1 | 22.8 | 22.8 | 24.3 |
| Temperature: °F. | −289.2 | −289.1 | −289.2 | −289.2 | −289.4 | −289.4 | −287.9 |
| Composition | | | | | | | |

TABLE IV-continued

| Stream No. | 350 | 351 | 355 | 356 | 360 | 361 | 362 |
|---|---|---|---|---|---|---|---|
| Oxygen: vol % | 99.93 | 99.85 | 99.92 | 99.92 | 99.95 | 99.94 | 98.36 |
| Argon: vppm | 388 | 243 | 372 | 372 | 500 | 400 | 232 |
| Krypton: vppm | 30.3 | 23.8 | 29.5 | 29.5 | 0.12 | 0.2 | 13,467 |
| Xenon: vppm | 2.29 | 1.20 | 2.17 | 2.17 | 1.57 | — | 1,025 |
| Methane: vppm | 265.8 | 1,225 | 371.3 | 371.3 | 13.7 | 235.2 | 1,691 |

The krypton recovery is comparable to that achieved using the process of FIG. 3 (99.9%) and 2% greater than that reported in U.S. Pat. No. 4.,568,528 (97.3%). Methane removal in the example for FIG. 4 is also comparable to that attained using the process of FIG. 3 (99.1%) FIG. 4 yields results comparable to FIG. 3 but does not employ the condenser at the top of the krypton/xenon column as was required in FIG. 3.

Figure 5:
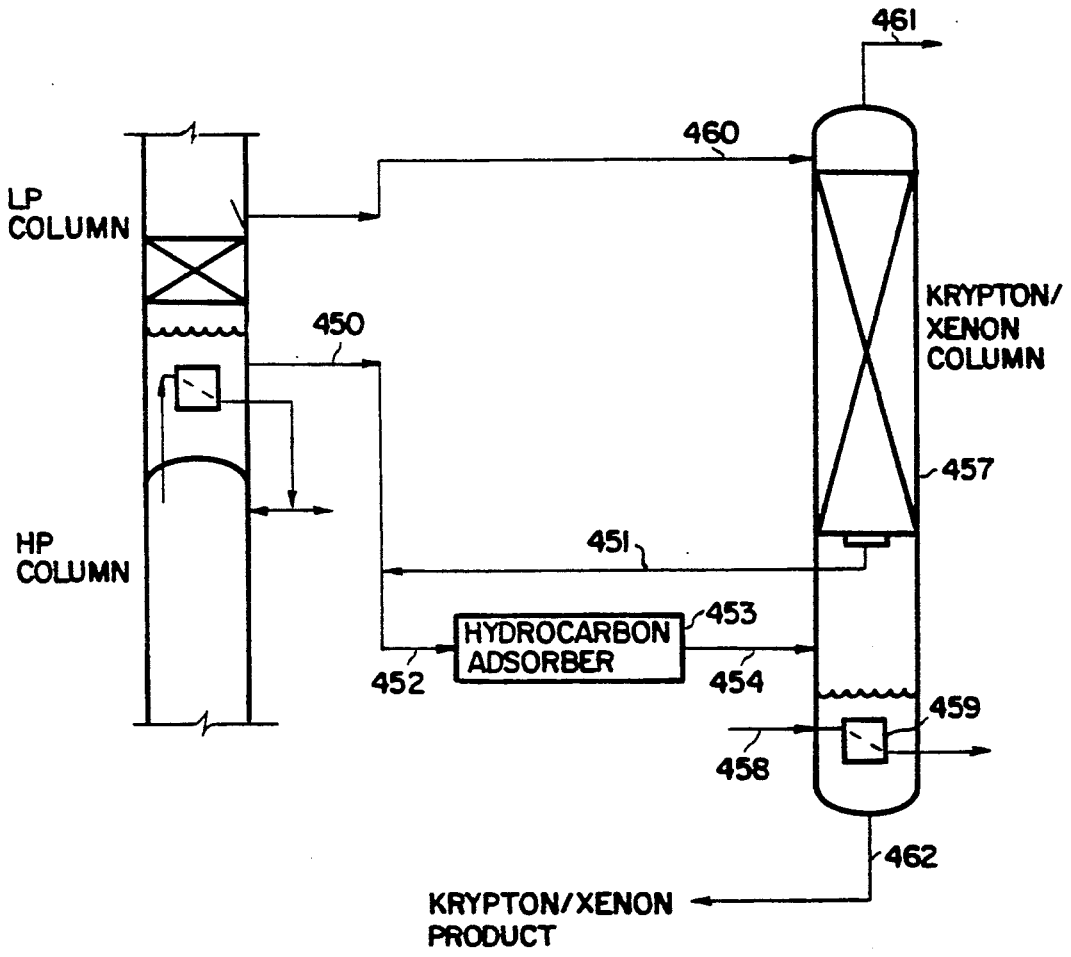

Another variation of the process of FIG. 4 is shown in FIG. 5. In the process of FIG. 5, return liquid 451 is withdrawn from krypton/xenon column 457 at a point below the bottom equilibrium stage and above the reboiling zone. Hydrocarbon adsorber product stream 454 is not split into two fractions as in FIG. 4, but is fed as a single stream to a point below the bottom equilibrium stage and above the reboiling zone. This embodiment of the process will result in decreased manufacturing costs and easier operation since there is only 1 tray section in FIG. 5 as compared to multiple tray sections in the process of FIG. 4. FIG. 5 was simulated using 23 theoretical stages in krypton/xenon column 457 and a reflux ratio of 0.11 (identical to the example for FIG. 4) as shown in Table V. Krypton recovery (same definition as previously) was 99.5% and methane removal (same definition as previously) was 98.7% as compared to 99.4% and 98.6%, respectively, for FIG. 4. FIG. 5 yields results that are comparable to results for FIG. 3 but a condenser is not employed at the top of the krypton/xenon column in FIG. 5.

TABLE V

| Stream No. | 450 | 451 | 454 | 460 | 461 | 462 |
|---|---|---|---|---|---|---|
| Flow: mol/hr | 89.0 | 11.0 | 100.0 | 11.0 | 99.8 | 0.2 |
| Pressure: psia | 23.1 | 24.2 | 23.1 | 22.8 | 22.8 | 24.3 |
| Temperature: °F. | −289.2 | −288.1 | −289.2 | −289.4 | −289.4 | −287.9 |
| Composition | | | | | | |
| Oxygen: vol % | 99.93 | 99.38 | 99.87 | 99.95 | 99.94 | 98.37 |
| Argon: vppm | 388 | 244 | 372 | 500 | 400 | 233 |
| Krypton: vppm | 30.3 | 4726 | 546.8 | 0.12 | 0.1 | 13,487 |
| Xenon: vppm | 2.29 | 16.9 | 3.90 | 1.57 | — | 1,026 |
| Methane: vppm | 265.8 | 1209 | 369.5 | 13.7 | 235.5 | 1,515 |

EMBODIMENT 4

Figure 6:
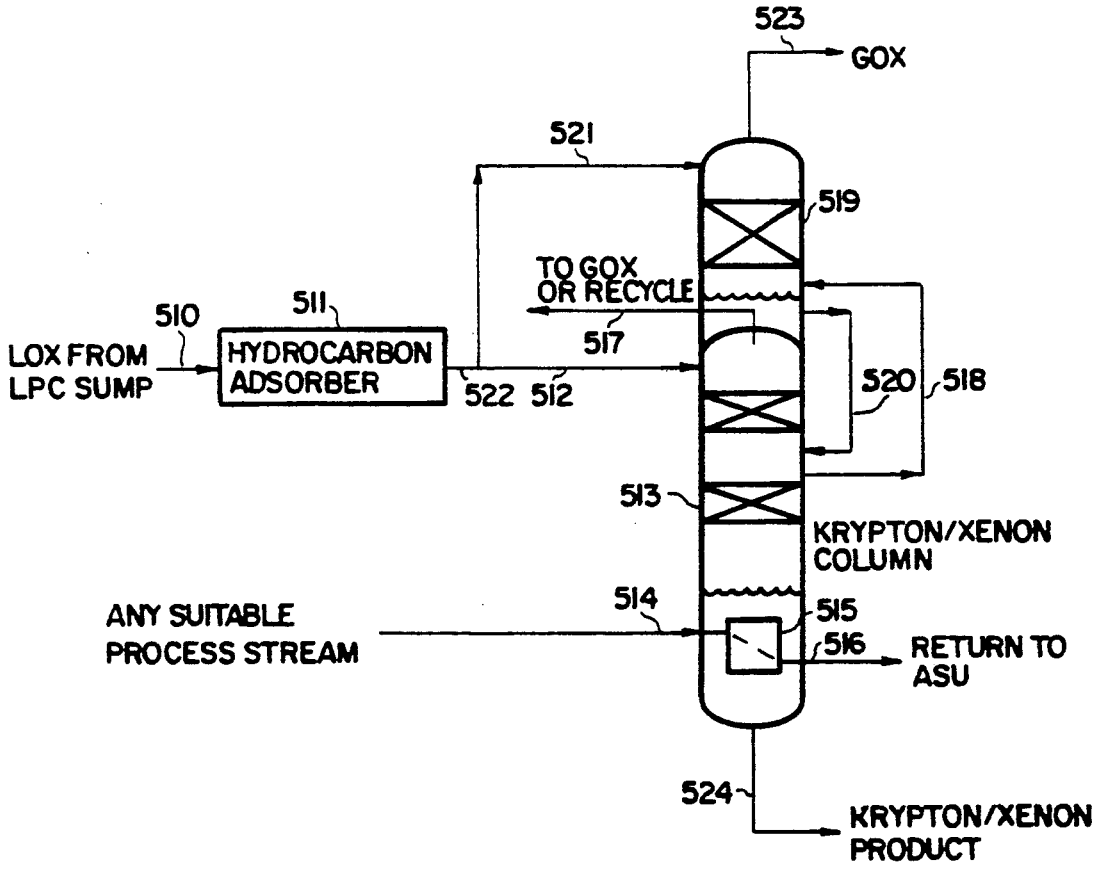

This process consists of a hydrocarbon adsorber and two distillation columns as shown in FIG. 6. A liquid oxygen stream withdrawn from the sump of a suitable distillation column of the main air separation unit (stream 510) is passed through a hydrocarbon adsorber 511 that removes hydrocarbons and nitrous oxide, with the exception of methane, from the process stream. Typically the suitable place is the sump of the LP column of a standard double column air separation unit. Liquid oxygen stream 512, containing argon, krypton, xenon, and methane is fed to the krypton/xenon column 513. Boilup in krypton/xenon column 513 is provided by indirect heat exchange between liquid in the sump of 513 and any suitable process stream 514 in reboiler 515. Examples of streams suitable for stream 514 include, but are not limited to, gaseous nitrogen withdrawn from the high pressure column (as shown) or liquid withdrawn from the sump of the high pressure column. Process stream 516 can be recycled to an appropriate place in the standard double column air separation unit, or used as a condensing or reboiling fluid in another indirect heat exchanger, or any combination of the above. In krypton/xenon column 513, up-flowing vapor strips down-flowing liquid of argon, oxygen, and to a lesser degree, methane such that vapor stream 517 will consist of oxygen and argon with some residual methane. Since the L/V in the top section of this krypton/xenon column is typically greater than one, vapor stream 517 will be essentially krypton and xenon-free and also concentration of methane would be substantially small. Up-flowing vapor preferentially strips argon, oxygen, and methane from down-flowing liquid as argon is more volatile than oxygen which is more volatile than methane. Krypton and xenon are both less volatile than methane and are not stripped by the vapor. Stream 517 can be recovered as gaseous oxygen product or recycled to the low pressure column.

Vapor stream 518 is withdrawn at any suitable point between the feed stream and above the bottom of the krypton/xenon column and fed to a demethanizing column 519 at a point directly above the liquid sump. Liquid from the bottom of the demethanizing column 519 is returned to krypton/xenon column 513 via liquid stream 520 that is fed to krypton/xenon column 513 at a suitable location. Vapor stream 518 is concentrated with respect to krypton, xenon and methane. Demethanizing column 519 is refluxed with liquid oxygen stream 521 that contains lower concentrations of krypton, xenon, and methane than vapor stream 518. One possible source for such a stream is a portion of feed stream 522, as shown. Other sources of such liquid streams can be a liquid stream from a few trays above the bottom sump of the LP column, an ultra-high purity liquid oxygen stream from an ultra-high purity oxygen plant etc. In demethanizing column 519, down-flowing liquid removes krypton and xenon preferentially to other components from the ascending vapor stream. As a result, vapor stream 523, exiting the top of demethanizing column 519, is essentially krypton and xenon-free. However, liquid to vapor flow ratios (L/V) are chosen such that vapor stream 523 contains greater than 90% of the methane that entered the process in stream 510. Vapor stream 523 is recovered as gaseous oxygen product. Liquid product stream 524 is withdrawn from the reboiler sump of krypton/xenon column Stream 524 consists of krypton, xenon and some methane concentrated in oxygen.

Table VI tabulates the results of a computer simulation performed on the process as shown in FIG. 6. The stream numbers correspond to FIG. 6.

TABLE VI

| Stream No. | 510 | 512 | 518 | 520 | 521 | 523 | 524 |
|---|---|---|---|---|---|---|---|
| Flow: mol/hr | 109.0 | 100.0 | 90.0 | 9.0 | 9.0 | 90.0 | 0.20 |
| Pressure: psia | 24.1 | 23.1 | 23.3 | 23.5 | 23.1 | 22.7 | 23.4 |
| Temperature: °F. | −289 | −289.2 | −288.9 | −288.8 | −289.2 | −289.5 | −288.6 |
| Composition | | | | | | | |
| Oxygen: vol % | 99.93 | 99.93 | 99.92 | 99.76 | 99.93 | 99.94 | 98.10 |
| Argon: vol % | 0.04 | 0.04 | 0.034 | 0.022 | 0.04 | 0.036 | 0.015 |
| Krypton: vppm | 27.1 | 27.1 | 68.9 | 695 | 27.1 | 2.06 | 13,664 |
| Xenon: vppm | 2.05 | 2.05 | 0.01 | 2.1 | 2.05 | 0.01 | 1,113 |
| Methane: vppm | 238.1 | 238.1 | 360 | 1,192 | 238.1 | 264.6 | 3,978 |

Comparison of product stream 524 of Table VI with the corresponding stream from U.S. Pat. 4,568,528 reveals an increase in krypton concentration by a factor of 32 (from 427 vppm in said patent to 13,664 vppm in current invention), and an increase in xenon concentration by a factor of 41.2 (from 27 vppm said patent to 1,113 vppm in current invention). These several fold increases in concentration are more remarkable when one considers the fact that the feed to the krypton/xenon column in the patent has higher concentrations of krypton and xenon (39.1 vppm vs. 27.1 vppm krypton and 2.5 ppm vs. 2.05 ppm xenon). It is worth noting that due to higher concentrations of krypton and xenon in the product from the bottom of the krypton/xenon column, the flowrate of this stream is substantially lower for this process. This leads to substantial decrease in the size of equipment used downstream of the krypton/xenon column to further purify krypton and xenon. These results are compiled in Table VII.

TABLE VII

| | U.S. Pat. No. 4,568,528 | Stream 524 of FIG. 6 |
|---|---|---|
| Relative Flow | 8.8 | 1.0 |
| Oxygen: vol % | 99.6 | 98.1 |
| Methane: vppm | 4,000 | 3,980 |
| Krypton: vppm | 427 | 13,664 |
| Xenon: vppm | 27 | 1,113 |

Figure 7:
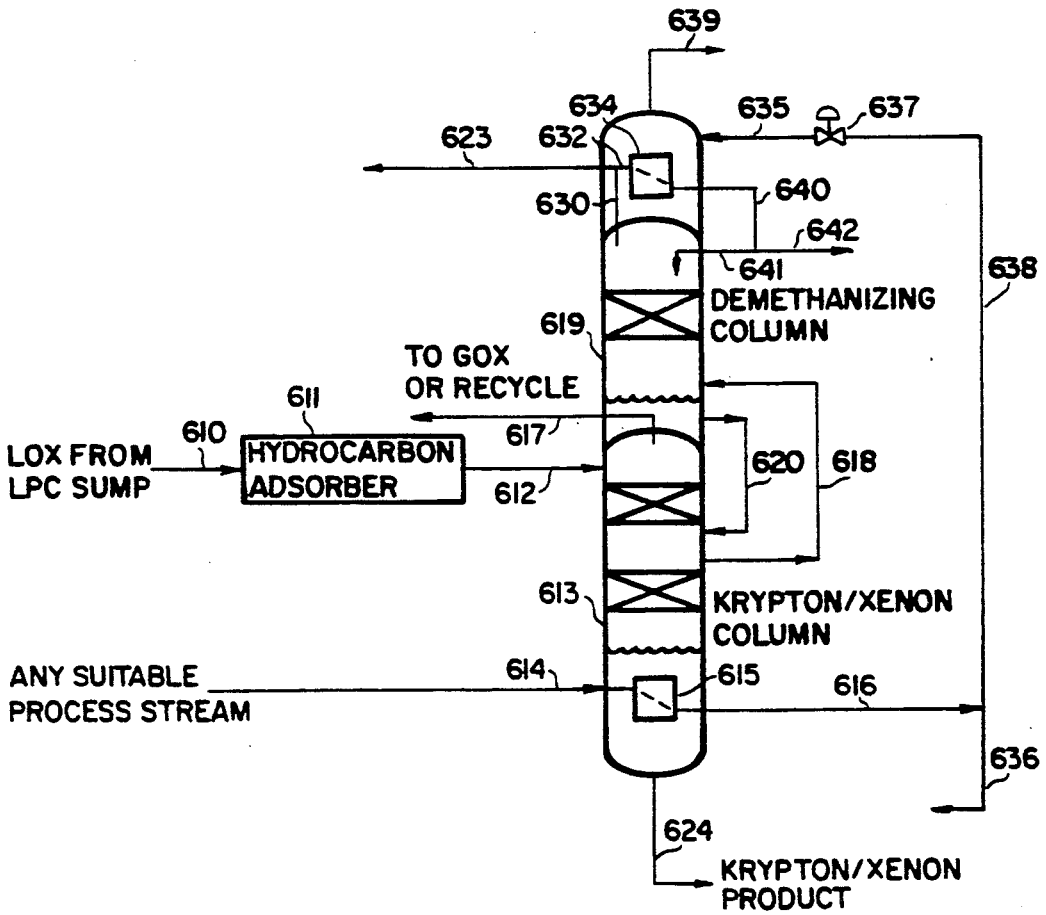

FIG. 7 illustrates another version of the process in which reflux liquid to the demethanizing column is provided by a condenser. In demethanizing column 619, ascending vapor 630, which is essentially krypton and xenon-free, is collected above the top tray and split into two streams 623 and 632. Stream 623 is recovered as gaseous oxygen product. Stream 632 is condensed by indirect heat exchange with any suitable process stream 635 in condenser 634. One such stream is a fraction of condensate stream 616 from reboiler 615, as shown. Stream 616 is divided into stream 636, that is returned to an appropriate place in the high pressure column, and stream 638, that subsequently has its pressure decreased by flowing across valve 637 to form reduced pressure stream 635, that is vaporized to stream 639 by condensing stream 632. Stream 639 can be recycled to the LP column or recovered as gaseous nitrogen product. Liquid condensate 640 can be split into two fractions, stream 641 and 642. Stream 641 is returned to demethanizing column 619 above the top tray as liquid reflux. Stream 642 is recovered as a liquid oxygen product or used a process stream in further operations or both. More than 90% of the methane that entered the process in stream 610 is removed in streams 623 and 642, the gaseous oxygen and liquid oxygen product streams, respectively. It will be evident to those who are skilled in the art that the system described in FIG. 7 allows for the recovery of oxygen from demethanizing column 619 as either all gaseous oxygen (stream 623) or all liquid oxygen (stream 642) or any combination of gaseous oxygen and liquid oxygen.

It will also be evident to those skilled in the art that condenser 634 can be a discrete piece of equipment at the top of demethanizing column 619 (as shown) or be integrated with another condenser in a different location, such as the argon column condenser. If integrated with the argon column condenser then the vapor from the top of demethanizing column 619 will be condensing against boiling the same fluid which is boiled by the crude argon from the argon column condenser. Typically this fluid is crude liquid oxygen from the bottom of the high pressure column. When integrated in such a manner, it will substantially reduce the cost associated with the use of a condenser at the top of demethanizing column 619.

Table VIII tabulates the results of a computer simulation performed on the process as shown in FIG. 7.

TABLE VIII

| Stream No. | 612 | 617 | 618 | 620 | 623 | 624 |
|---|---|---|---|---|---|---|
| Flow: mol/hr | 100.0 | 18.6 | 90.0 | 8.75 | 81.25 | 0.2 |
| Pressure: psia | 23.1 | 22.8 | 23.3 | 22.6 | 21.8 | 23.4 |
| Temperature: °F. | −289.2 | −289.4 | −288.9 | −289.5 | −290.2 | −288.6 |
| Composition | | | | | | |
| Oxygen: vol % | 99.93 | 99.93 | 99.92 | 99.79 | 99.94 | 98.2 |
| Argon: vol % | 0.04 | 0.06 | 0.034 | 0.022 | 0.035 | 0.014 |
| Krypton: vppm | 27.1 | 1.9 | 67.0 | 687 | 0.3 | 13,292 |
| Xenon: vppm | 2.05 | — | 0.01 | 0.1 | — | 1,024 |
| Methane: vppm | 238.1 | 71.5 | 357.1 | 1,194 | 267 | 3,946 |

This FIG. 7 process represents a significant improvement as compared to the process in FIG. 6 with respect to krypton loss in stream 523 because the concentration of krypton in stream 623 is now only 0.3 ppm as compared 2.06 ppm in stream 523. Use of a condenser to provide reflux, as in FIG. 7, results in a decrease in krypton loss from the demethanizing column by a factor of 8.

The embodiments of the present invention work by taking advantage of the different relative volatilities of xenon, krypton, and methane. The boiling point of xenon is higher than that of krypton which is higher than that of methane. Therefore, for a vapor-liquid mixture at equilibrium at a given temperature (such a mixture exists on each tray of a distillation column) there will be a partitioning of xenon, krypton, and methane into both the vapor and liquid phases, with this partitioning governed by the relative volatilities. A larger percentage of the total xenon will be found in the liquid phase as compared to krypton and methane whereas a larger percentage of the total methane will be found in the vapor phase as compared to krypton and xenon.

The differences in relative volatilities are exploited in the krypton/xenon column (Embodiments 1-3) and in the demethanizing column (Embodiment 4) to separate krypton from methane. The objective is to separate methane and krypton such that gaseous oxygen product withdrawn from the top of the column contains almost all of the methane and none of the krypton that entered in the feed streams. The separation is accomplished by controlling the liquid to vapor ratio (reflux ratio) in the column by controlling the flowrate of liquid reflux. The effect of reflux ratio on krypton recovery and methane removal is presented in the above Table II. In this case, increasing the reflux ratio above the optimum of 0.17 results in a substantial decrease in methane rejection whereas decreasing the reflux ratio below 0.09 results in a substantial decrease in krypton recovery. Similar results are also obtained for Embodiment 2 (FIG. 3) and for Embodiment 3 (FIGS. 4 and 5).

Table IX shows the effects of changing the reflux ratio in the demethanizing column for the process shown in FIG. 6.

TABLE IX

| | Case 1 | Case 2 | Case 3 |
|---|---|---|---|
| Reflux Ratio | 0.10 | 0.17 | 0.067 |
| Equilibrium Stages | 13 | 13 | 26 |
| Stream 523 Flow: mol/hr | 90.0 | 90.0 | 90.0 |
| Stream 523 Methane: mol/hr | 0.0238 | 0.0186 | 0.0234 |
| Stream 523 Krypton: mol/hr | $185 \times 10^{-6}$ | $168 \times 10^{-6}$ | $592 \times 10^{-6}$ |
| Stream 524 Flow: mol/hr | 0.20 | 1.80 | 0.20 |
| Stream 524 Krypton: vppm | 13664 | 1615 | 11248 |
| Stream 524 Xenon: vppm | 1113 | 131 | 1081 |
| Stream 524 Methane: vppm | 3978 | 3980 | 3455 |

The optimum reflux ratio for this column is approximately 0.1 (Case 1) as also shown in the above Table VI. In general, increasing the reflux ratio will result in a decrease in the amount of methane removed in stream 523 and an accompanying increase in the methane content of product stream 524. Decreasing the reflux ratio will, in general, result in an increased loss of krypton in stream 523 as sufficient reflux is not available to wash krypton from the vapor. Increasing the reflux ratio in the demethanizing column to 0.17 (Case 2) results in a decrease in the methane removed in stream 523 (as compared to Case 1). The flowrate of product stream 524 must be increased in order to maintain the methane content of this stream below the maximum allowable level. For the example of Table IX, the flow of product stream 524 was increased by a factor of 9, with a subsequent reduction of the krypton and xenon concentrations by a factor of approximately 9. Note that the mass flow rates of krypton and xenon remained relatively unchanged from Case 1 to Case 2. The increased flowrate of product stream 524 is undesirable as this leads to larger equipment sizes for downstream processes. Decreasing the reflux ratio in the demethanizing column to 0.067 (Case 3) results in an increased krypton loss in stream 523. In principle, it is possible to reduce this loss by increasing the number of equilibrium stages in the demethanizing column. The number of equilibrium stages was doubled from 13 to 26 as shown in Table IX. Despite the increased number of equilibrium stages in Case 3, the amount of krypton lost in stream 523 increased by a factor of 3.2 and the amount of krypton recovered in product stream 524 decreased by 18%

The invention is of value because due to higher concentration of krypton and xenon in the stream from the krypton/xenon column, the flow rate of this stream is much smaller leading to reduction in downstream equipment size used to further purify krypton and xenon. Furthermore, less methane has to be removed now in downstream processing.

Even though liquid feed containing krypton and xenon has been shown in FIGS. 2 through 7 to come from the sump of the low pressure column of an air distillation unit, it should be understood that such a feed may be withdrawn from an suitable location of an air separation unit. For example, for an air separation plant designed to produce primarily nitrogen, in which krypton and xenon are concentrated in the sump where the richest liquid oxygen is boiled to produce the oxygen-rich waste stream, the liquid feed to the krypton/xenon column would be liquid withdrawn from such sump. If needed, a few trays may be added above this sump to insure that krypton and xenon i$ not exiting with the oxygen-rich waste stream.

The present invention has been described with reference to several specific embodiments thereof. These embodiments should not be considered to be a limitation on the scope of the present invention. The scope of the present invention should be ascertained from the following claims.

We claim:

1. In a process for the production of krypton and xenon from a liquid feed stream comprising oxygen, methane, krypton and xenon in a krypton/xenon cryogenic distillation column system having at least one distillation column, wherein the liquid feed stream is introduced to the krypton/xenon cryogenic distillation column system for fractionation into an bottoms liquid enriched in krypton and xenon and an overhead lean in krypton and xenon and said krypton/xenon cryogenic distillation column system has a region wherein oxygen is enriched, the improvement for simultaneously maximizing the concentration of krypton and xenon and the rejection of methane comprises operating said region wherein oxygen is enriched so that ratio of liquid to vapor flow is in the range between 0.05 and 0.2.

2. The process of claim 1 wherein the ratio of liquid to vapor flow is 0.1.

3. The process of claim 1 which further comprises removing any $C_2$+hydrocarbons and nitrous oxide from the liquid feed stream in an adsorber prior to introducing the feed stream to the krypton/xenon distillation column system.

4. In a process for the production of krypton and xenon from a liquid feed stream comprising oxygen, methane, krypton and xenon in a single krypton/xenon cryogenic distillation column, wherein the liquid feed stream is introduced to the bottom of the single distillation column for fractionation into an bottoms liquid enriched in krypton and xenon and an overhead lean in krypton and xenon and the single distillation column has a region wherein oxygen is enriched, the improvement for simultaneously maximizing the concentration of krypton and xenon and the rejection of methane comprises operating said region wherein oxygen is enriched so that ratio of liquid to vapor flow is in the range between 0.05 and 0.2.

5. The process of claim 4 wherein an effective amount of reflux is provided to said oxygen enriching region of the krypton/xenon distillation column system by introducing at least a portion of the liquid feed stream to the top of said region so as to allow operation of said region within the liquid to vapor flow range.

6. The process of claim 4 wherein an effective amount of reflux is provided to said oxygen enriching region of the krypton/xenon distillation column system by condensing at least a portion of the overhead and returning said condensed portion to the top of said region so as to allow operation of said region within the liquid to vapor flow range.

7. The process of claim 4 wherein an effective amount of reflux is provided to said oxygen enriching region of the krypton/xenon distillation column system by introducing an oxygen containing liquid stream removed from an appropriate location of a low pressure column of an air separation unit to the top of said region so as to allow operation of said region within the liquid to vapor flow range; and which further comprises removing liquid descending the single distillation column at a location above the bottom liquid feed to the single distillation column; combining said removed liquid into the liquid feed stream, and then removing any $C_2$+hydrocarbons and nitrous oxide from the liquid feed stream in an adsorber prior to introducing the feed stream to the single distillation column.

8. The process of claim 4 wherein an effective amount of reflux is provided to said oxygen enriching region of the krypton/xenon distillation column system by introducing an oxygen containing liquid stream removed from an appropriate location of a low pressure column of an air separation unit to the top of said region in combination with an effective amount of additional reflux is provided by introducing at least a portion of the liquid feed stream to an intermediate location of said region so as to allow operation of said region within the liquid to vapor flow range; and which further comprises removing liquid descending the single distillation column at a location above point of introduction of the additional reflux; combining said removed liquid into the liquid feed stream; then removing any $C_2$+hydrocarbons and nitrous oxide from the liquid feed stream in an adsorber prior to removing a portion of the liquid feed for the additional reflux and introducing the remaining portion to the single distillation column.

9. In a process for the production of krypton and xenon from a liquid feed stream comprising oxygen, methane, krypton and xenon in a krypton/xenon cryogenic distillation system comprising a first and a second distillation column, wherein a first portion of the liquid feed stream is introduced into the top of the first distillation column for fractionation into a first bottoms liquid and a first overhead, wherein a second portion of the liquid feed stream is introduced into the top of the second distillation column for fractionation into a second bottoms and a second overhead, wherein a vapor stream is withdrawn from an intermediate location of the first distillation column and fed to the bottom of the second distillation column and wherein the second bottoms liquid is withdrawn and fed to the intermediate location of the first distillation column, the improvement for simultaneously maximizing the concentration of krypton and xenon and the rejection of methane comprises operating said second distillation column so that ratio of liquid to vapor flow is in the range between 0.05 and 0.2.

10. The process of claim 9 which further comprises removing any $C_2$+hydrocarbons and nitrous oxide from the first and second portions o the liquid feed stream in an adsorber prior to introducing the feed stream to the krypton/xenon distillation column system.

11. In a process for the production of krypton and xenon from a liquid feed stream comprising oxygen, methane, krypton and xenon in a krypton/xenon cryogenic distillation system comprising a first and a second distillation column, wherein the liquid feed stream is introduced into the top of the first distillation column for fractionation into a first bottoms liquid and a first overhead, wherein a vapor stream is withdrawn from an intermediate location of the first distillation column and fed to the bottom of the second distillation column for rectification, wherein the second bottoms liquid is withdrawn and fed to the intermediate location of the first distillation column and wherein reflux is provided to the second distillation column by condensing at least a portion of the second column overhead and returning said condensed overhead portion to the top of the second distillation column, the improvement for simultaneously maximizing the concentration of krypton and xenon and the rejection of methane comprises operating said second distillation column so that ratio of liquid to vapor flow is in the range between 0.05 and 0.2.

12. The process of claim 10 which further comprises removing any $C_2$+hydrocarbons and nitrous oxide from the liquid feed stream in an adsorber prior to introducing the feed stream to the krypton/xenon distillation column system.

* * * * *